US006149744A

United States Patent [19]

Fukuda et al.

[11] Patent Number: 6,149,744

[45] Date of Patent: Nov. 21, 2000

[54] METHOD OF MAKING AUSTENITIC STAINLESS STEEL SHEET

[75] Inventors: Kunio Fukuda; Takumi Ujiro; Masaaki Kohno; Susumu Satoh; Masahiro Yoshioka; Shinji Yamazaki, all of Chiba, Japan

[73] Assignee: Kawasaki Steel Corporation, Japan

[21] Appl. No.: 09/177,470

[22] Filed: Oct. 23, 1998

[30] Foreign Application Priority Data

Oct. 28, 1997 [JP] Japan ..... 9-295663
Mar. 30, 1998 [JP] Japan ..... 10-084785

[51] Int. Cl.[7] ..... C21D 8/02

[52] U.S. Cl. ..... 148/611; 134/41

[58] Field of Search ..... 148/611, 609, 148/610; 134/3, 28, 41

[56] References Cited

FOREIGN PATENT DOCUMENTS

| | | |
|---|---|---|
| 0 355 452 | 2/1990 | European Pat. Off. . |
| 0 367 112 | 5/1990 | European Pat. Off. . |
| 0 796 922 | 9/1997 | European Pat. Off. . |
| 54-056939 | 5/1979 | Japan . |
| 60-248889 | 12/1985 | Japan . |
| 61-245912 | 11/1986 | Japan . |
| 63-230892 | 9/1988 | Japan . |
| 63-297599 | 12/1988 | Japan . |
| 5-222558 | 8/1993 | Japan . |
| 6-010172 | 1/1994 | Japan . |
| 6-017271 | 1/1994 | Japan . |
| 6-065765 | 3/1994 | Japan . |
| 9-049092 | 2/1997 | Japan . |

OTHER PUBLICATIONS

English Abstract of JP406065765A, Mar. 8, 1994.

*Primary Examiner*—Deborah Yee
*Attorney, Agent, or Firm*—Austin R. Miller

[57] ABSTRACT

Method of making a hot-rolled steel sheet having superior surface appearance, free of surface patterns and uneven glossiness from an austenitic stainless steel slab containing about 0.03 percent by weight or more of Cu, about 0.03 percent by weight or more of V, and about 0.01 percent by weight or more of Mo under any of the following conditions: (A) pickling in a nitric-hydrofluoric acid solution containing about 20 to 100 g/l of nitric acid and about 100 to 300 g/l of hydrofluoric acid; (B) controlling nitric-hydrofluoric acid content in response to the iron ion content in the solution; (C) a preliminary pickling step prior to finishing pickling; (D) grinding about 2 μm or more of the surface after preliminary pickling and prior to finishing pickling; (E) causing counterflow with a relative flow rate of 0.5 to 5.0 m/sec on the sheet surface during finishing pickling; (F) adding sulfuric acid or sulfurous acid as a hydrogen ion source to the nitric-hydrofluoric acid solution; and (G) electrolysing during finishing pickling such that the ratio of the cathodic electrolysis time to the anodic electrolysis time is about 3 or more.

20 Claims, 3 Drawing Sheets

CONVENTIONAL PROCESS

CONVENTIONAL PROCESS

METHOD OF MAKING AUSTENITIC STAINLESS STEEL SHEET

BACKGROUND OF THE INVENTION

1. Field of the Invention

The present invention relates to a method of making an austenitic stainless steel sheet having excellent surface evenness, uniformity and appearance after hot rolling.

2. Description of the Related Art

Austenitic stainless steels such as SUS304 have high heat resistance, corrosion resistance and workability, and are widely used for making various products by hot rolling, annealing, pickling, cold rolling, finishing annealing, and pickling.

The surface of a hot-rolled steel sheet is generally uneven because of the presence of surface scales formed during casting and hot-rolling the slab. When such a hot-rolled steel sheet is annealed in a general annealing atmosphere, that is, a combustive atmosphere, the steel sheet surface pattern has uneven glossiness or whiteness after pickling. This surface pattern damages the appearance of roofs and other panels made from the steel sheet.

In recent years, tandem rolling using a large roll has been applied to cold rolling of austenitic stainless steel, as well as plain carbon steel, in order to enhance productivity and to reduce production cost. Since such large roll does not effectively crush the surface defects or diminish intergranular penetration on the hot-rolled steel sheet, as compared with the use of conventional small rolls, the resulting cold-rolled steel sheet has remarkably uneven glossiness distribution.

Examples of surface defects include grooves formed by intergranular penetration, pit-type penetration in grains, and bite marks. In austenitic stainless steel, substrate barely dissolves during pickling. Hence the surface defects tend to remain on the hot-rolled sheet after pickling, as compared with ferritic stainless steel.

Various methods as follows have been proposed to minimize the foregoing surface defects in austenitic stainless steel.

An acid having strong dissolving ability can be used to completely dissolve groove-type corrosion and etched pits, as disclosed in Japanese Patent Laid-Open No. 60-248889. Since a large amount of scrap metal has been recently used as a source, the resulting austenitic stainless steel often contains rather large amounts of Cu, V and Mo. FIGS. 1A and 1B are graphs showing the solubility of SUS304 stainless steel sheets A, B, C containing these impurities, as shown in the following Table 9, in two acid mixtures of nitric acid and hydrofluoric acid (hereinafter referred to as nitric-hydrofluoric acid). The dissolving rate in pickling decreases with a increase of concentration of the impurities, probably due to surface passivation, a change in reaction potential, and the effect of nitride near the surface. Such a process requires a prolonged period to completely remove by dissolution the groove-type corrosion and etched pits from the surface of the steel sheet, resulting in a significant decrease of production speed and efficiency.

According to the present inventors' Japanese Patent Laid-Open No. 8-269549, mechanical descaling may be performed before annealing a hot-rolled steel sheet to minimize grooves of intergranular penetration for the purpose of improving the glossiness of the steel sheet. When scales are unevenly formed during hot rolling in this method, it is difficult to perform complete descaling and to remove unevenness from substrate texture. As a result, uneven glossiness on the steel surface still remains after such treatment, although the total glossiness is indeed improved.

Japanese Patent Laid-Open No. 60-177135 discloses a process including annealing for a short time in an inert or reductive gas or in vacuum and then rapidly cooling the steel sheet in order to suppress intergranular penetration of the hot-rolled steel sheet. This process, however, does not improve unevenness of the scales formed during hot rolling, and results in inevitable formation of a pattern on the surface of the steel sheet, even though suppressing formation of intergranular penetration during annealing.

Japanese Patent Laid-Open No. 6-10171 discloses a method for mechanically grinding a ferritic stainless steel sheet and then pickling it in nitric-hydrofluoric acid of a specified concentration. Austenitic stainless steel shows a quite different pickling mechanism as distinguished from that of ferritic stainless steel. That is, dissolution of austenitic stainless steel is significantly inactive when exposed to nitric-hydrofluoric acid because of the open circuit potential in the acid compared with that of the ferritic stainless steel. Thus, the surface defects on the austenitic stainless steel sheet cannot be removed using a pickling solution having an acid concentration that does not form so-called smuts, as disclosed in Japanese Patent Laid-Open No. 6-10171. The ferritic stainless steel significantly dissolves in sulfuric acid, whereas the austenitic stainless steel substantially does not do so. Accordingly, this method is not applicable to austenitic stainless steel.

SUMMARY OF THE INVENTION

Accordingly, it is an object of the present invention to provide a method of making a hot-rolled or cold-rolled austenitic stainless steel sheet having excellent surface characteristics, particularly uniform surface glossiness, without decreasing productivity.

The method in accordance with the present invention includes hot rolling, annealing and pickling of an austenitic stainless steel, wherein the pickling solution comprises about 20 to 100 g/l of nitric acid and about 100 to 300 g/l of hydrofluoric acid.

Preferably, when the metal ion concentration C (g/l) in the pickling solution is in the range of about $0 \leqq C \leqq 25$, the nitric acid concentration A (g/l) and the free hydrofluoric acid concentration B (g/l) substantially satisfy the relationships (1) and (2) stated below, respectively; and when the metal ion concentration C is about 25 or greater, the nitric acid concentration A and the free hydrofluoric acid concentration B substantially satisfy the relationships (3) and (4) stated below:

$$20+1.10\times C \leqq A \leqq 100 \quad (1)$$

$$100+0.05\times C^2 \leqq B \leqq 300+0.05\times C^2 \quad (2)$$

$$20+0.75\times C \leqq A \leqq 100 \quad (3)$$

$$132 \leqq B \leqq 330 \quad (4)$$

Preferably, the method further comprises combined pickling including a preliminary pickling step for preliminarily pickling the austenitic stainless steel with sulfuric acid, hydrochloric acid or a mixed acid solution of nitric acid and hydrofluoric acid, followed by the pickling step.

Preferably, the method further includes a mechanical grinding step for mechanically grinding the surface of the stainless steel sheet between the preliminary pickling step and the pickling step (which may be hereinafter referred to as finishing pickling).

Preferably, the pickling solution further contains at least one acid selected from the group consisting of sulfuric acid and sulfurous acid.

Preferably, a counterflow is imparted along the surface of the steel sheet in the pickling step. Preferably, the counterflow has a relative flow rate to the steel sheet in a range of about 0.5 to 5.0 m/sec.

The steel sheet may contain about 0.03 percent by weight or more of Cu, about 0.03 percent by weight or more of V, and about 0.01 percent by weight or more of Mo.

Preferably, the pickling step includes both cathodic and anodic electrolytic treatment at a ratio of cathode electrolysis time to anode electrolysis time of about 3 or more.

In accordance with the present invention, a hot-rolled austenitic stainless steel sheet having superior appearance, free of surface patterns and uneven glossiness, is obtained by annealing and pickling in a short period of time.

Other objects and advantages of the invention will be more apparent to those skilled in the art on consideration of the accompanying drawings and following the several Examples, which are intended to be illustrative but not to limit or define the scope of the invention, which is defined in the appended claims.

DESCRIPTION OF PREFERRED EMBODIMENTS

Figure 1A:
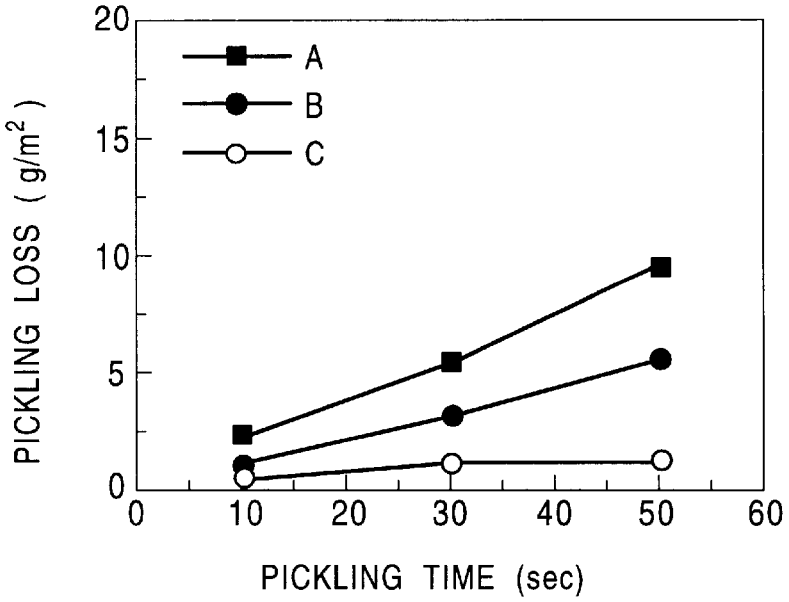
FIGS. 1A and 1B are graphs showing the relationship between the amount of steel sheet dissolved and the pickling time in nitric-hydrofluoric acid solutions at 50° C. in a conventional process (hydrofluoric acid content: 30 g/l in FIG. 1A and 200 g/l in FIG. 1B; nitric acid content: 100 g/l in FIG. 1A and 150 g/l in FIG. 1B)
Figure 1B:
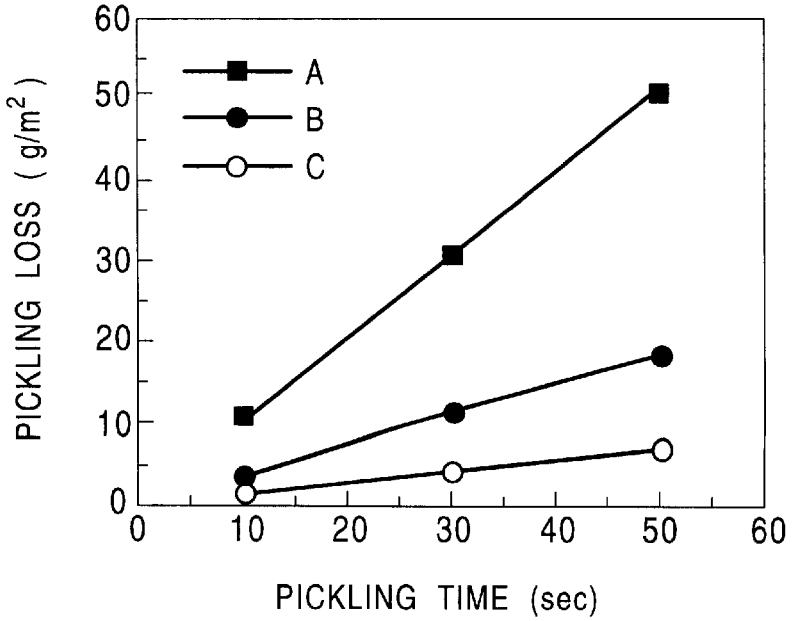

Preliminary findings by the inventors in relation to the invention will be described first, for better understanding.

Scales formed on the surface of an austenitic stainless steel sheet during hot rolling are primarily composed of corundum-type oxides ($(Fe,Cr)_2O_3$) and spinel-type oxides ($(Fe,Cr)_3O_4$) and the thickness of the scales varies at different positions on the sheet surface. A large amount of FeO is locally present. The oxidizing mechanism during annealing after hot rolling depends on the thickness of the scales and the abundance of these oxides and results in uneven glossiness. Use of scrap metal as a source results in an uneven texture in substrate during hot rolling, probably due to increases in the Cu, V and Mo contents or uneven formation of the hot-rolling scales. Such an uneven texture also causes uneven glossiness because of different oxidation behaviors during coiling and annealing. The uneven glossiness on the hot-rolled steel sheet during annealing and pickling can be prevented by dissolving a large amount of uneven texture in substrate and on the surface. Even when the SUS304 stainless steel shows inferior pickling characteristics due to an increase in the content of impurities, such as Cu, V and Mo, the uneven texture can be uniformly dissolved in a short time in a pickling solution having a specified acid content range, that is, a low nitric acid content and a high free hydrofluoric acid content which does not form a complex with metallic ions. Since the rate-determining step in the pickling reaction is dissolution of substrate, removal of this portion by mechanical grinding is effective for reducing pickling time. The rate of dissolution reaction of substrate can be increased by prompting diffusion of fluoride ions and hydrogen ions in the pickling solution, or by forming a counterflow near the surface of the steel sheet. We have found that pickling characteristics are decreased with an increase in the metal ion concentration in the pickling solution even when the nitric acid concentration and the free hydrofluoric acid concentration are constant. Thus, the action of the pickling solution is assisted by an additional treatment that recovers pickling characteristics in response to the metal ion concentration. We have found that effective methods for rapid dissolution include use of an oxidizing acid, as a hydrogen ion source, having a weaker oxidizing property than that of nitric acid together with nitric-hydrofluoric acid; and a cathodic electrolytic time that is longer than the anodic electrolytic time in nitric-hydrofluoric acid.

In the method in accordance with the present invention, substantially all types of conventional hot-rolled austenitic stainless steel sheets, of various chemical compositions, can be used. Typical austenitic stainless steel sheets contain (hereinafter percentages are percent by weight) about 0.08% or less of C, about 1.00% or less of Si, about 2.00% or less of Mn, about 7.00 to 15.00% of Ni, about 10.0 to 30.0% of Cr, and about 0.25% or less of N. In the present invention, the austenitic stainless steel sheets may contain about 0.03% or more of Cu, about 0.03% or more of V, and about 0.01% or more of Mo as impurities. Allowable contents of these impurities are determined in consideration of desired mechanical properties and other characteristics of the steel sheet. It is unnecessary for the present invention to apply upper limits to these impurities; general austenitic stainless steel sheets contain about 0.03 to 3.00% of Cu, about 0.03 to 3.00% of V, and about 0.01 to 6.00% of Mo.

The steel sheet is immersed into a nitric-hydrofluoric acid solution containing about 20 to 100 g/l of nitric acid and about 100 to 300 g/l of hydrofluoric acid to remove scales on its surface in the pickling step.

We have found that, after hot rolling the steel, annealing the hot-rolled sheet, and pickling the hot-rolled sheet, the surface pattern of the hot-rolled steel corresponds to the difference in glossiness on the surface of the steel sheet after annealing and pickling. An effective means for eliminating the surface pattern is the formation of a surface oxide after hot rolling, the oxide essentially consisting of either a corundum-type or a spinel-type, or by dissolving a large amount of the surface texture in pickling.

We have studied the relationships among the Cr content of the steel, the concentrations of various acids, and the amounts of dissolved textures. According to our observations, the surface region of the hot-rolled steel sheet contains a large amount of ferritic texture of a low Cr content, whereas the inner ground steel region is substantially composed of an austenitic texture having a high Cr content. We have found that no significant surface pattern will be formed when at least about 5 $\mu$m of austenitic texture having a high Cr content in substrate region is dissolved. This substrate region, however, is not substantially dissolved under conventional pickling conditions, for example, 100 g/l of nitric acid, 30 g/l of hydrofluoric acid, and a temperature of 50° C., even after immersion for a prolonged period.

In the present invention, the steel sheet is immersed into a mixed acid solution containing about 20 to 100 g/l of nitric acid and about 100 to 300 g/l of hydrofluoric acid in the pickling step to remove scales. In the surface area of the hot-rolled steel sheet having a relatively low Cr content, the solubility increases with an increase in the concentration of nitric acid or hydrofluoric acid. In contrast, the dissolving rate of the substrate region significantly decreases when the nitric acid content is higher than about 100 g/l. The solubility of this region also decreases due to a decrease in hydrogen ions when the nitric acid content is lower than about 20 g/l. The substrate region is not substantially dissolved when the hydrofluoric acid content is lower than about 100 g/l. The solubility of this region also decreases by hindered diffusion and dissociation of ions when the hydrofluoric acid content is higher than about 300 g/l. In consideration of these results, pickling in the present invention is performed in a mixed acid solution containing about 20 to 100 g/l of nitric acid and about 100 to 300 g/l of hydrofluoric acid to remove scales.

Figure 2:
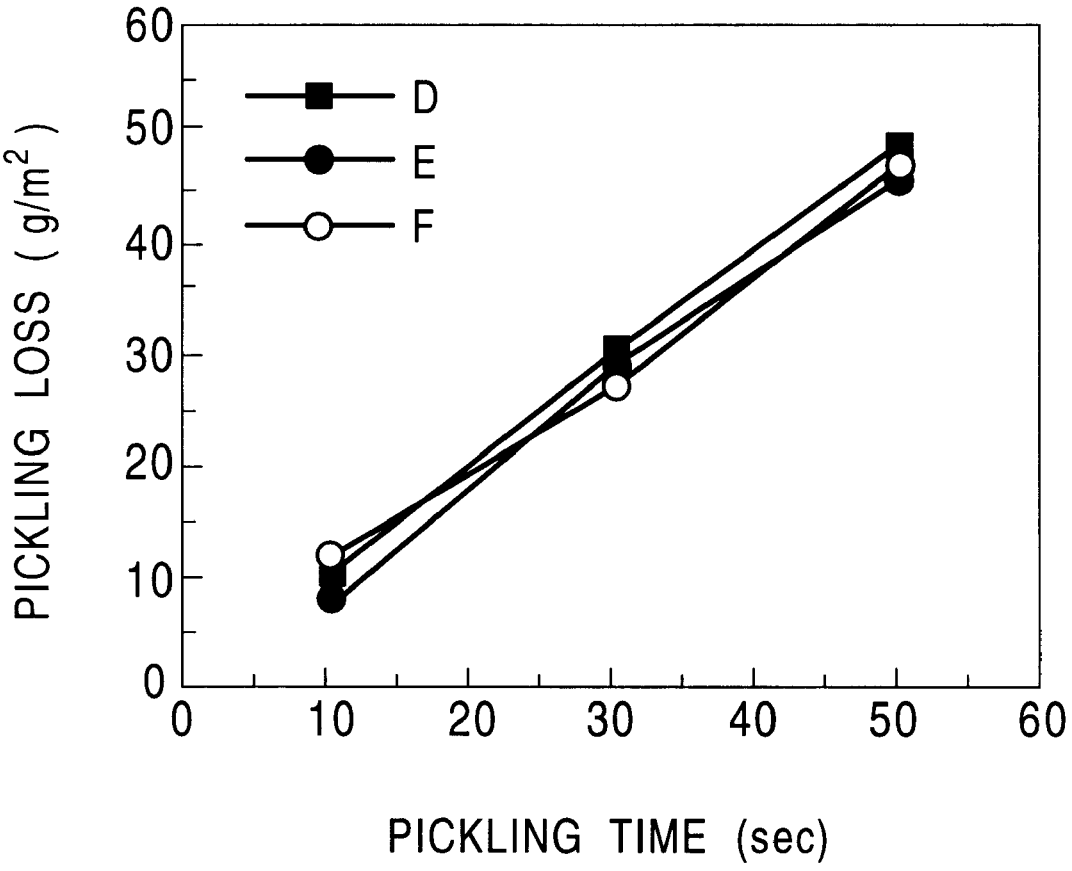
FIG. 2 is a graph showing the relationship between the amount of steel sheet dissolved and the pickling time in a nitric-hydrofluoric acid solution at 50° C. in accordance with the present invention (hydrofluoric acid content: 200 g/l; nitric acid content: 50 g/l; and metallic ion content: 0 g/l)

FIG. 2 is a graph showing the relationship between the amount of steel sheet dissolved and pickling time when three SUS304 steel sheets D, E, and F containing impurities such as Cu, V and Mo (the compositions are shown in the following Table 9) were immersed into a mixed acid solution containing about 50 g/l of nitric acid and about 200 g/l of hydrofluoric acid at 50° C. FIG. 2 shows that the dissolving rate does not decrease when the impurity content increases. Accordingly, in the present invention, the steel sheet is immersed into a mixed acid solution containing about 20 to 100 g/l of nitric acid and about 100 to 300 g/l of hydrofluoric acid in the pickling step to remove scales. Preferably, the nitric acid content is in a range of about 40 to 75 g/l, and the hydrofluoric acid content is in a range of about 150 to 220 g/l.

TABLE 9

| Steel No. | C | Si | Mn | P | S | Cr | Ni | Cu | V | Mo | N | O |
|---|---|---|---|---|---|---|---|---|---|---|---|---|
| A | 0.06 | 0.40 | 1.00 | 0.03 | 0.006 | 18.5 | 8.30 | 0.01 | 0.01 | 0.01 | 0.04 | 0.005 |
| B | 0.06 | 0.40 | 1.00 | 0.03 | 0.006 | 18.5 | 8.30 | 0.03 | 0.05 | 0.02 | 0.04 | 0.005 |
| C | 0.06 | 0.40 | 1.00 | 0.03 | 0.006 | 18.5 | 8.30 | 0.31 | 0.10 | 0.07 | 0.04 | 0.005 |
| D | 0.06 | 0.40 | 1.00 | 0.03 | 0.006 | 18.5 | 8.30 | 0.01 | 0.01 | 0.005 | 0.04 | 0.005 |
| E | 0.06 | 0.40 | 1.00 | 0.03 | 0.006 | 18.5 | 8.30 | 0.03 | 0.03 | 0.01 | 0.04 | 0.005 |
| F | 0.06 | 0.40 | 1.00 | 0.03 | 0.006 | 18.5 | 8.30 | 0.31 | 0.10 | 0.07 | 0.04 | 0.005 |

In the present invention, the contents of nitric acid and hydrofluoric acid are controlled to specified ranges in response to the metallic ion content. The specified ranges are determined on a basis of the relationships between the increment of the metallic ion content and the contents of nitric acid and free hydrofluoric acid. In the hot-rolled stainless steel sheet, the surface region with a relatively low Cr content is more significantly dissolved at a higher nitric acid or hydrofluoric acid content. The substrate region with high Cr content has a significantly decreased dissolving rate when the nitric acid content is increased. The solubility of the substrate region with high Cr content is also decreased when the nitric acid content is excessively low, since a decrease in hydrogen ions and oxidizing ability inhibits oxidation of $Fe^{2+}$ ions into $Fe^{3+}$ ions which do not substantially cling the surface of steel. The solubility of the substrate region is also decreased when hydrofluoric acid contents excessively low, since dissolved area of steels decreased. And, the solubility of the substrate region is also decreased when hydrofluoric acid contents excessively high, since the dissociation of diffused hydrogen ions is inhibited. The pickling effect is moderated as the metallic ion concentration increases by pickling even when the nitric acid and hydrofluoric acid contents do not change, and is saturated at a metallic ion content of about 25 g/l for a nitric-hydrofluoric acid solution of the present invention.

Figure 3:
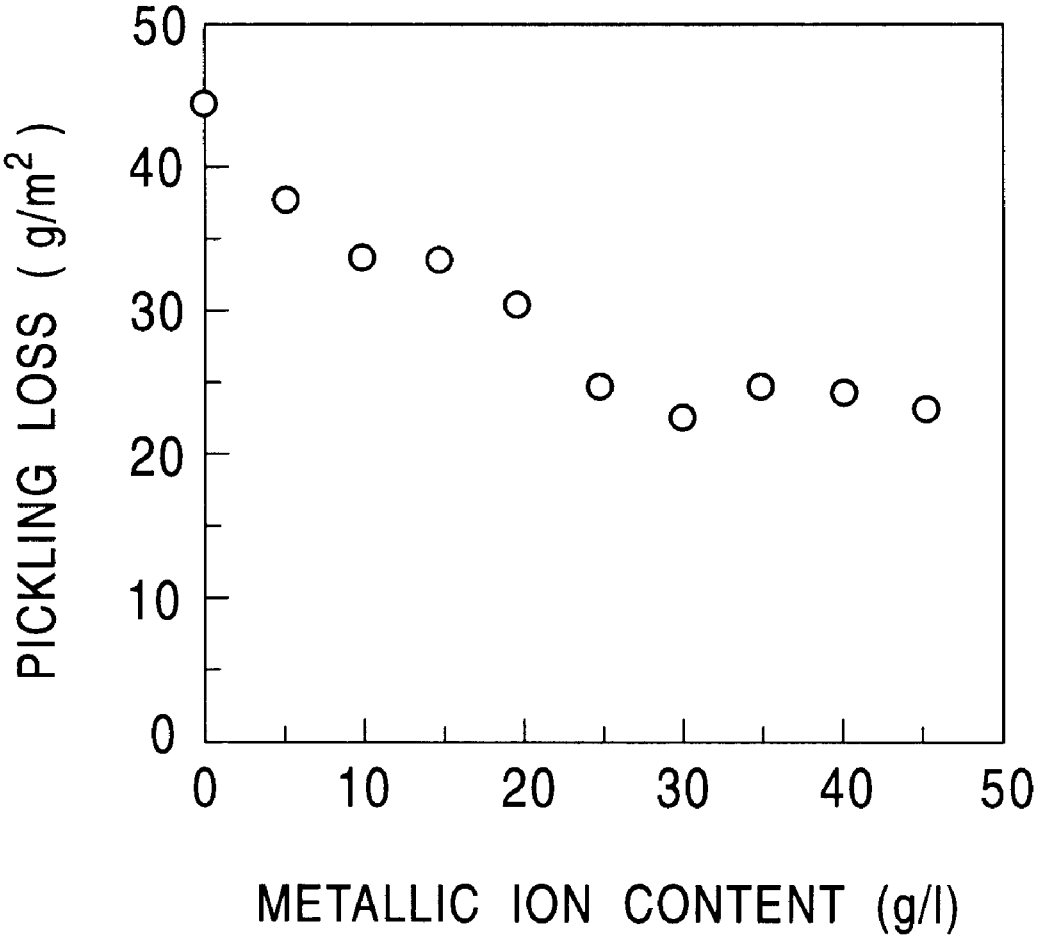
FIG. 3 is a graph showing the relationship between the amount of steel sheet dissolved and the metallic ion content in a nitric-hydrofluoric acid solution at 50° C. in accordance with the present invention (hydrofluoric acid content: 150 g/l; nitric acid content: 50 g/l; and pickling time: 100 seconds).

FIG. 3 is a graph showing the relationship between the amount of steel sheet dissolved and the metallic ion content during pickling in a nitric-hydrofluoric acid solution of the present invention. Thus, the acid content is determined in response to the metallic ion content. The above-mentioned relationships are derived from these results. Accordingly, the stainless steel sheet is immersed into a nitric-hydrofluoric acid solution satisfying these relationships in the pickling step for removing scales.

In the present invention, preliminary pickling is performed using sulfuric acid, hydrochloric acid or nitric-hydrofluoric acid, prior to finishing pickling with nitric-hydrofluoric acid. The surface region containing a relatively large amount of ferritic texture having a low Cr content can be easily dissolved into acid with low solution ability. When the finish pickling with a nitric-hydrofluoric acid solution of the present invention is performed after removing the surface scale layer and the surface layer, a much more even surface is obtained. Preferably, the preliminary pickling is performed using sulfuric acid or nitric-hydrofluoric acid.

It is preferred that mechanical grinding by a brush be performed after preliminary pickling and prior to finishing pickling using nitric-hydrofluoric acid. If the stainless steel sheet with scales is subjected to grinding by a brush before pickling, the austenitic texture region, having a high Cr content in the substrate which causes a surface pattern, is not substantially ground although the low-Cr region is removed. The scales inhibit uniform grinding of the surface and form an undesirable pattern.

In contrast, when grinding and finishing pickling are performed after parts of the scales and the low-Cr layer on the surface are removed by preliminary pickling, a satisfactory surface is formed. Accordingly, mechanical grinding is preferably performed after preliminary pickling and prior to finishing pickling in the present invention.

Examples of acids used in preliminary pickling include sulfuric acid, nitric-hydrofluoric acid, and hydrochloric acid. Among them, sulfuric acid and nitric-hydrofluoric acid are preferred. The acid content and the temperature of the pickling solution are appropriately determined.

When one surface of the hot-rolled sheet is mechanically ground to a thickness of about 2.0 $\mu$m or more, the subsequent finishing pickling is more satisfactorily performed. Although the upper limit of mechanical grinding is not limited, excessive grinding results in a low production yield and production of sparks during mechanical grinding. Thus, the thickness of the ground surface is preferably in a range of about 2.0 to 30.0 $\mu$m.

The mechanical grinding is preferably performed by a brush, high-pressure water, or a grinder. Mechanical descaling such as shot blasting after preliminary pickling is undesirable since it causes the undesired formation of surface defects.

In the present invention, it is preferred that sulfuric acid or sulfurous acid as a hydrogen ion source be added to the nitric-hydrofluoric acid solution. These compounds have a lower oxidizing power than that of nitric acid in the nitric-hydrofluoric acid solution.

According to our findings, substrate with high Cr content is dissolved by a hydrogen-forming reaction in the nitric-hydrofluoric acid solution. Although our results suggest that further addition of hydrogen ions accelerates the dissolving rate, an increase in hydrogen ions by further addition of nitric acid causes a decrease in the dissolving rate of the substrate region with high Cr content, as described above. This dissolving rate increases with the addition of an acid, such as sulfuric acid or sulfurous acid, having a lower oxidizing ability than that of nitric acid. It is considered that nitric acid (about 100 g/l or more), permanganic acid and chromic acid having high oxidizing ability tend to cause passivation of the surface of the high-Cr austenitic texture, resulting in a decrease in the area participating in the dissolving reaction. Although the volume of sulfuric acid or sulfurous acid is appropriately determined in consideration of processing time, an excessive amount of addition forms smuts. Thus, it is preferable that the concentration of the added acid be in a range of about 0.05 to 0.5N.

It is preferred that a counter flow is generated on the surface of the steel sheet during finishing pickling. The dissolving reaction is controlled by diffusion of fluoride ions and hydrogen ions in the solution, and diffusion of $Fe^{2+}$ ions from the surface of steels. Fluoride ions attack the passivating film on the substrate region with high Cr content to increase the reactive area. Hydrogen ions promote a charge transfer reaction between the metal and hydrogen ions. The diffusion of $Fe^{2+}$ ions from the surface prevents trapping of $Fe^{2+}$ ions on the surface and increases the reactive area.

According to our results, diffusion of acid by counterflow on the surface is effective when using a nitric-hydrofluoric acid solution in accordance with the present invention. The rate of the counter flow is preferably in a range of about 0.5 m/sec to 5.0 m/sec. That is, the effect of the counter flow is apparent at a rate of at least about 0.5 m/sec, and saturates at a rate of about 5.0 m/sec. A higher flow rate is achieved with technical difficulty and an increase in facility cost. Thus, the counterflow rate is more preferably in the range of about 0.5 m/sec to 2.0 m/sec.

In the present invention, it is preferable that electrolytic treatment be employed during finishing pickling such that the ratio of the cathodic electrolysis time to the anodic electrolysis time is about 3 or more. The cathodic electrolysis accelerates dissolution, whereas the anodic electrolysis decelerates dissolution. Such a change in dissolution rate is independent of the quantity of electricity and dependent on electrolysis time. The open circuit potential of the austenitic region is approximately −300 mV (vs SCE) in the nitric-hydrofluoric acid solution, and it is a potential near the hydrogen-generating reaction. The reaction of the austenitic region near this potential is activated dissolution in which the current density decreases as the potential increases.

Accordingly, as the potential increases, the current density decreases, resulting in suppressed dissolution. In contrast, as the potential decreases, the current density increases. In actual operation, however, it is difficult to perform only cathodic electrolysis. Thus quantity of electricity in the cathodic electrolysis is decreased compared with that in the anodic electrolysis and the cathodic electrolysis time is prolonged compared with that in the anodic electrolysis time, so that the dissolution rate is increased. When the cathodic electrolysis time is at least about three times the anodic electrolysis time, the dissolution rate is increased. When the cathodic electrolysis time is further prolonged, the quantity of electricity in the anodic electrolysis undesirably increases. Thus, the ratio is more preferably in a range of about 5 to 20 times. It is preferable that the quantity of electricity be in a range of about 40 to 200 C/dm$^2$, although a quantity outside that range is also effective. Accordingly, the ratio of the cathodic electrolysis time to the anodic electrolysis time is preferably about 3 or more.

The annealing temperature and time and the sheet thickness are not limited in accordance with the present invention, and are determined depending on particular use. When the temperature of the nitric-hydrofluoric acid solution is too low, the dissolution reaction is inactivated. When the temperature is too high, gas such as $NO_x$ vigorously evolves. Thus, the preferable temperature is in a range of about 55° C. to 70° C. The hot-rolled steel sheet may be subjected to a descaling treatment such as shot blasting or mechanical scale bending prior to pickling.

The following Examples are illustrative of specific tests that were performed by us. They are not intended to define or to limit the scope of the invention, which is defined in the appended claims.

EXAMPLE 1

A series of austenitic stainless steel slabs, having the compositions shown in the following Table 1, were prepared. The slabs were maintained at 1,250° C. for 1 hour and then were subjected to hot rolling to form hot-rolled steel sheets with a thickness of 4.0 mm. Each hot-rolled steel sheet was subjected to annealing at 1,150° C. for 30 sec, to shot blasting as a pretreatment for pickling, and to pickling in a nitric-hydrofluoric acid solution, as shown in the following Table 2. The sheet was subjected to temper rolling at a rolling reduction of 5%. Unevenness of glossiness of the resulting steel sheet was observed. The glossiness was evaluated by JIS Z8741, in which ten samples were used with glossiness observed at ten white sections and ten black sections of each sample, and the difference between the white sections and the black sections was evaluated as the surface pattern of the steel sheet.

The results are shown in Table 2, in which level A denotes an excellently uniform surface, level B denotes an unsatisfactory surface with a slightly visible pattern (sample No. 16), and level C (sample No. 11–15, 17 and 18) denotes a distinctly unsatisfactory surface.

Table 2 shows that pickling in accordance with the present invention provided excellent surfaces without a visible pattern within a short period of time. When the acid content deviated from the scope of the present invention, the surface pattern was not distinguishable, or in the alternative a prolonged pickling time was required to remove the surface pattern.

TABLE 1

| C | Si | Mn | P | S | Cr | Ni | Cu | V | Mo | N | O |
|---|---|---|---|---|---|---|---|---|---|---|---|
| 0.06 | 0.40 | 1.00 | 0.03 | 0.006 | 18.5 | 8.30 | 0.30 | 0.11 | 0.03 | 0.04 | 0.005 |

TABLE 2

| Sample No. | Nitric acid- (g/l) | Hydrofluoric acid (g/l) | Metallic ions (g/l) | Nitric acid content in relationship (1) or (3) | Hydrofluoric acid content in relationship (2) or (4) | Temp. (° C.) | Pickling time (sec) | Maximum difference in glossiness | Appearance | Level | Remarks |
|---|---|---|---|---|---|---|---|---|---|---|---|
| 1 | 80 | 200 | 20 | $42 \leqq A \leqq 100$ | $120 \leqq B \leqq 320$ | 60 | 120 | 25 | Excellent | A | Within the invention |
| 2 | 30 | 150 | 5 | $25.5 \leqq A \leqq 100$ | $101 \leqq B \leqq 301$ | 60 | 120 | 20 | Excellent | A | Within the invention |
| 3 | 40 | 150 | 10 | $31 \leqq A \leqq 100$ | $105 \leqq B \leqq 305$ | 55 | 120 | 25 | Excellent | A | Within the invention |
| 4 | 50 | 150 | 30 | $42.5 \leqq A \leqq 100$ | $132 \leqq B \leqq 330$ | 60 | 120 | 15 | Excellent | A | Within the invention |
| 5 | 90 | 200 | 30 | $42.5 \leqq A \leqq 100$ | $132 \leqq B \leqq 330$ | 60 | 120 | 15 | Excellent | A | Within the invention |
| 6 | 30 | 250 | 30 | $42.5 \leqq A \leqq 100$ | $132 \leqq B \leqq 330$ | 60 | 120 | 10 | Excellent | A | Within invention |
| 7 | 25 | 180 | 10 | $31 \leqq A \leqq 100$ | $105 \leqq B \leqq 305$ | 65 | 150 | 30 | Excellent | A | Within the invention |
| 8 | 60 | 120 | 25 | $47.5 \leqq A \leqq 100$ | $131 \leqq B \leqq 330$ | 65 | 150 | 15 | Excellent | A | Within the invention |
| 9 | 40 | 200 | 30 | $42.5 \leqq A \leqq 100$ | $132 \leqq B \leqq 330$ | 60 | 150 | 20 | Excellent | A | Within the invention |
| 10 | 70 | 120 | 30 | $42.5 \leqq A \leqq 100$ | $132 \leqq B \leqq 330$ | 60 | 150 | 25 | Excellent | A | Within the invention |
| 11 | 15 | 200 | 20 | $42 \leqq A \leqq 100$ | $120 \leqq B \leqq 320$ | 60 | 150 | 60 | Unevenly patterned | C | For comparison |
| 12 | 10 | 150 | 30 | $42.5 \leqq A \leqq 100$ | $132 \leqq B \leqq 330$ | 60 | 150 | 70 | Unevenly patterned | C | For comparison |
| 13 | 50 | 90 | 20 | $42 \leqq A \leqq 100$ | $120 \leqq B \leqq 320$ | 60 | 150 | 70 | Unevenly patterned | C | For comparison |
| 14 | 80 | 95 | 10 | $31 \leqq A \leqq 100$ | $105 \leqq B \leqq 305$ | 60 | 150 | 80 | Unevenly patterned | C | For comparison |
| 15 | 125 | 150 | 20 | $42 \leqq A \leqq 100$ | $120 \leqq B \leqq 320$ | 60 | 350 | 50 | Unevenly patterned | C | For comparison |
| 16 | 150 | 200 | 30 | $42.5 \leqq A \leqq 100$ | $132 \leqq B \leqq 330$ | 60 | 300 | 25 | Excellent | B | For comparison |
| 17 | 100 | 30 | 10 | $31 \leqq A \leqq 100$ | $105 \leqq B \leqq 305$ | 60 | 600 | 80 | Unevenly patterned | C | Conventional |
| 18 | 100 | 30 | 30 | $42.5 \leqq A \leqq 100$ | $132 \leqq B \leqq 330$ | 60 | 750 | 75 | Unevenly patterned | C | Conventional |

EXAMPLE 2

A series of austenitic stainless steel slabs having the compositions shown in Table 3 were subjected to sample No. 19–38 which appear in the following Table 4.

The slabs were maintained at 1,250° C. for 1 hour and then were subjected to hot rolling to form hot-rolled steel sheets with a thickness of 4.0 mm. Each hot-rolled steel sheet was subjected to annealing at 1,150° C. for 30 sec, to shot blasting as a pretreatment for pickling, and to pickling in a sulfuric acid solution (200 g/l, 80° C.) for 30 minutes. The sheet surface was subjected to mechanical grinding using a nylon brush under the conditions shown in Table 4. The ground sheet was subjected to pickling in a nitric-hydrofluoric acid solution shown in Table 4 and then temper rolling at a rolling reduction of 5%. Unevenness of glossiness of the resulting steel sheet was observed as in EXAMPLE 1.

The results are shown in Table 4. Table 4 shows that pickling in accordance with the present invention provided satisfactory surfaces without a visible pattern for a short period of time. When the acid content deviated from the scope of the present invention, the surface pattern was not distinguishable, or a prolonged pickling time was required to remove the surface pattern.

TABLE 3

| C | Si | Mn | P | S | Cr | Ni | Cu | V | Mo | N | O |
|---|---|---|---|---|---|---|---|---|---|---|---|
| 0.06 | 0.35 | 1.05 | 0.03 | 0.006 | 18.6 | 8.45 | 0.33 | 0.13 | 0.02 | 0.03 | 0.004 |

TABLE 4

| Sample No. | Grinding loss (μm) | Nitric acid (g/l) | Hydrofluoric acid (g/l) | Metallic ions (g/l) | Nitric acid content in relationship (1) or (3) | Hydrofluoric acid content in relationship (2) or (4) | Temp (° C.) | Pickling time (sec) | Maximum difference in glossiness | Appearance | Level | Remarks |
|---|---|---|---|---|---|---|---|---|---|---|---|---|
| 19 | 0.0 | 80 | 200 | 20 | 42 ≦ A ≦ 100 | 120 ≦ B ≦ 320 | 60 | 90 | 15 | Excellent | A | Within the invention |
| 20 | 0.0 | 30 | 150 | 5 | 25.5 ≦ A ≦ 100 | 101 ≦ B ≦ 301 | 60 | 90 | 20 | Excellent | A | Within the invention |
| 21 | 0.0 | 60 | 150 | 20 | 42 ≦ A ≦ 100 | 120 ≦ B ≦ 320 | 55 | 90 | 20 | Excellent | A | Within the invention |
| 22 | 0.0 | 50 | 150 | 30 | 42.5 ≦ A ≦ 100 | 132 ≦ B ≦ 330 | 65 | 90 | 20 | Excellent | A | Within the invention |
| 23 | 0.0 | 90 | 200 | 30 | 42.5 ≦ A ≦ 100 | 132 ≦ B ≦ 330 | 60 | 90 | 15 | Excellent | A | Within the invention |
| 24 | 0.0 | 50 | 250 | 10 | 31 ≦ A ≦ 100 | 105 ≦ B ≦ 305 | 55 | 90 | 20 | Excellent | A | Within the invention |
| 25 | 0.0 | 60 | 180 | 20 | 42 ≦ A ≦ 100 | 120 ≦ B ≦ 320 | 60 | 90 | 20 | Excellent | A | Within the invention |
| 26 | 0.0 | 85 | 150 | 25 | 47.5 ≦ A ≦ 100 | 131 ≦ B ≦ 330 | 65 | 90 | 15 | Excellent | A | Within the invention |
| 27 | 0.0 | 50 | 200 | 20 | 42 ≦ A ≦ 100 | 120 ≦ B ≦ 320 | 60 | 90 | 20 | Excellent | A | Within the invention |
| 28 | 0.0 | 80 | 130 | 15 | 36.5 ≦ A ≦ 100 | 111 ≦ B ≦ 311 | 60 | 90 | 20 | Excellent | A | Within the invention |
| 29 | 4.0 | 80 | 200 | 20 | 42 ≦ A ≦ 100 | 120 ≦ B ≦ 320 | 60 | 70 | 20 | Excellent | A | Within the invention |
| 30 | 5.0 | 45 | 250 | 30 | 42.5 ≦ A ≦ 100 | 132 ≦ B ≦ 330 | 65 | 70 | 15 | Excellent | A | Within the invention |
| 31 | 2.0 | 50 | 200 | 20 | 42 ≦ A ≦ 100 | 120 ≦ B ≦ 320 | 70 | 70 | 20 | Excellent | A | Within the invention |
| 32 | 4.0 | 50 | 150 | 10 | 31 ≦ A ≦ 100 | 105 ≦ B ≦ 305 | 65 | 70 | 25 | Excellent | A | Within the invention |
| 33 | 2.0 | 50 | 150 | 20 | 42 ≦ A ≦ 100 | 120 ≦ B ≦ 320 | 65 | 70 | 20 | Excellent | A | Within the invention |
| 34 | 3.0 | 30 | 180 | 30 | 42.5 ≦ A ≦ 100 | 132 ≦ B ≦ 330 | 70 | 70 | 15 | Excellent | A | Within the invention |
| 35 | 5.0 | 75 | 220 | 20 | 42 ≦ A ≦ 100 | 120 ≦ B ≦ 320 | 65 | 70 | 20 | Excellent | A | Within the invention |
| 36 | 2.0 | 85 | 200 | 15 | 36.5 ≦ A ≦ 100 | 111 ≦ B ≦ 311 | 60 | 70 | 25 | Excellent | A | Within the invention |
| 37 | 3.0 | 60 | 210 | 20 | 42 ≦ A ≦ 100 | 120 ≦ B ≦ 320 | 60 | 70 | 20 | Excellent | A | Within the invention |
| 38 | 5.0 | 75 | 280 | 30 | 42.5 ≦ A ≦ 100 | 132 ≦ B ≦ 330 | 60 | 70 | 25 | Excellent | A | Within the invention |

EXAMPLE 3

A series of austenitic stainless steel slabs having compositions shown in the following Table 5 were prepared and subjected to sample No. 39 to 58 reported in Table 6.

The slabs were maintained at 1,250° C. for 1 hour and then were subjected to hot rolling to form hot-rolled steel sheets having a thickness of 4.0 mm. Each hot-rolled steel sheet was subjected to annealing at 1,150° C. for 30 sec, to shot blasting as a pretreatment for pickling, and to pickling in a sulfuric acid solution (200 g/l, 80° C.) for 30 sec. The sheet surface was subjected to mechanical grinding using a brush under the conditions shown in Table 6. The ground sheet was subjected to pickling in a nitric-hydrofluoric acid solution shown in Table 6 while a counterflow having a flow rate shown in Table 6 was introduced, and then subjected to temper rolling at a rolling reduction of 5%. Unevenness of glossiness of the resulting steel sheet was observed as in EXAMPLE 1.

The results are shown in Table 6. Table 6 shows that pickling in accordance with the present invention provided satisfactory surfaces without a visible pattern for a shorter period of time.

TABLE 5

| C | Si | Mn | P | S | Cr | Ni | Cu | V | Mo | N | O |
|---|---|---|---|---|---|---|---|---|---|---|---|
| 0.06 | 0.45 | 1.25 | 0.03 | 0.006 | 18.8 | 8.63 | 0.32 | 0.08 | 0.05 | 0.03 | 0.004 |

TABLE 6

| Sample No. | Grinding loss (μm) | Nitric acid (g/l) | Hydrofluoric acid (g/l) | Metallic ions (g/l) | Nitric acid content in relationship (1) or (3) | Hydrofluoric acid content in relationship (2) or (4) | Temp (° C.) | Pickling time (sec) | Flow rate (m/sec) | Maximum difference in glossiness | Appearance | Level | Remarks |
|---|---|---|---|---|---|---|---|---|---|---|---|---|---|
| 39 | 0.0 | 80 | 200 | 20 | 42 ≦ A ≦ 100 | 120 ≦ B ≦ 320 | 60 | 60 | 0.3 | 20 | Excellent | A | Within the invention |
| 40 | 0.0 | 30 | 150 | 5 | 25.5 ≦ A ≦ 100 | 101 ≦ B ≦ 301 | 60 | 80 | 0.2 | 15 | Excellent | A | Within the invention |
| 41 | 0.0 | 60 | 150 | 20 | 42 ≦ A ≦ 100 | 120 ≦ B ≦ 320 | 55 | 80 | 0.2 | 15 | Excellent | A | Within the invention |
| 42 | 0.0 | 50 | 150 | 30 | 42.5 ≦ A ≦ 100 | 132 ≦ B ≦ 330 | 65 | 70 | 0.5 | 20 | Excellent | A | Within the invention |
| 43 | 0.0 | 90 | 200 | 30 | 42.5 ≦ A ≦ 100 | 132 ≦ B ≦ 330 | 60 | 70 | 1.0 | 15 | Excellent | A | Within the invention |
| 44 | 0.0 | 50 | 250 | 10 | 31 ≦ A ≦ 100 | 105 ≦ B ≦ 305 | 55 | 70 | 2.0 | 15 | Excellent | A | Within the invention |
| 45 | 0.0 | 60 | 180 | 20 | 42 ≦ A ≦ 100 | 120 ≦ B ≦ 320 | 60 | 65 | 2.5 | 25 | Excellent | A | Within the invention |
| 46 | 0.0 | 85 | 150 | 25 | 47.5 ≦ A ≦ 100 | 131 ≦ B ≦ 330 | 65 | 65 | 3.5 | 15 | Excellent | A | Within the invention |
| 47 | 0.0 | 50 | 200 | 20 | 42 ≦ A ≦ 100 | 120 ≦ B ≦ 320 | 60 | 65 | 4.0 | 25 | Excellent | A | Within the invention |
| 48 | 0.0 | 80 | 130 | 15 | 36.5 ≦ A ≦ 100 | 111 ≦ B ≦ 311 | 60 | 65 | 4.5 | 20 | Excellent | A | Within the invention |
| 49 | 3.0 | 80 | 200 | 20 | 42 ≦ A ≦ 100 | 120 ≦ B ≦ 320 | 60 | 65 | 0.3 | 20 | Excellent | A | Within the invention |
| 50 | 4.0 | 45 | 250 | 30 | 42.5 ≦ A ≦ 100 | 132 ≦ B ≦ 330 | 65 | 65 | 0.2 | 15 | Excellent | A | Within the invention |
| 51 | 2.0 | 50 | 200 | 20 | 42 ≦ A ≦ 100 | 120 ≦ B ≦ 320 | 70 | 65 | 0.1 | 25 | Excellent | A | Within the invention |
| 52 | 3.0 | 50 | 150 | 10 | 31 ≦ A ≦ 100 | 105 ≦ B ≦ 305 | 65 | 55 | 0.5 | 25 | Excellent | A | Within the invention |
| 53 | 5.0 | 50 | 150 | 20 | 42 ≦ A ≦ 100 | 120 ≦ B ≦ 320 | 65 | 55 | 2.0 | 20 | Excellent | A | Within the invention |
| 54 | 3.0 | 80 | 180 | 30 | 42.5 ≦ A ≦ 100 | 132 ≦ B ≦ 330 | 70 | 55 | 1.0 | 15 | Excellent | A | Within the invention |
| 55 | 3.0 | 75 | 220 | 20 | 42 ≦ A ≦ 100 | 120 ≦ B ≦ 320 | 65 | 55 | 1.5 | 15 | Excellent | A | Within the invention |
| 56 | 2.0 | 85 | 200 | 15 | 36.5 ≦ A ≦ 100 | 111 ≦ B ≦ 311 | 60 | 50 | 3.5 | 20 | Excellent | A | Within the invention |
| 57 | 4.0 | 60 | 210 | 20 | 42 ≦ A ≦ 100 | 120 ≦ B ≦ 320 | 60 | 50 | 4.0 | 25 | Excellent | A | Within the invention |
| 58 | 5.0 | 75 | 280 | 30 | 42.5 ≦ A ≦ 100 | 132 ≦ B ≦ 330 | 60 | 50 | 5.0 | 25 | Excellent | A | Within the invention |

EXAMPLE 4

A series of austenitic stainless steel slabs with compositions shown in Table 7 were subjected to sample 59–78 appearing in Table 8.

The slabs were maintained at 1,250° C. for 1 hour and then were subjected to hot rolling to form hot-rolled steel sheets with a thickness of 4.0 mm. Each hot-rolled steel sheet was subjected to annealing at 1,150° C. for 30 sec, to shot blasting as a pretreatment for pickling, and to pickling in a nitric-hydrofluoric acid solution (nitric acid: 100 g/l, hydrofluoric acid: 50 g/l, temperature: 50° C.) for 30 sec. The sheet surface was subjected to mechanical grinding using a brush under the conditions shown in Table 8. The ground sheet was subjected to pickling in a nitric-hydrofluoric acid solution containing sulfurous acid or sulfuric acid under the electrolysis conditions shown in Table 8, and was then subjected to temper rolling of a rolling reduction of 5%. Unevenness of glossiness of the resulting steel sheet was observed as in EXAMPLE 1.

The results are shown in Table 8. Table 8 shows that pickling in accordance with the present invention provided excellent surfaces without a visible pattern in a shorter period of time.

TABLE 7

| C | Si | Mn | P | S | Cr | Ni | Cu | V | Mo | N | O |
|---|---|---|---|---|---|---|---|---|---|---|---|
| 0.05 | 0.33 | 1.54 | 0.02 | 0.006 | 18.6 | 8.72 | 0.23 | 0.16 | 0.03 | 0.03 | 0.005 |

TABLE 8

| Sample No. | Grinding loss (μm) | Nitric acid (g/l) | Hydro-fluoric acid (g/l) | Metallic ions (g/l) | Nitric acid content in relationship (1) or (3) | Hydrofluoric acid content in relationship (2) or (4) | Temp (° C.) | Pickling time (sec) | Sulfuric acid (N) |
|---|---|---|---|---|---|---|---|---|---|
| 59 | 0.0 | 80 | 200 | 20 | 42 ≦ A ≦ 100 | 120 ≦ B ≦ 320 | 60 | 80 | 0.03 |
| 60 | 0.0 | 30 | 150 | 5 | 25.5 ≦ A ≦ 100 | 101 ≦ B ≦ 301 | 60 | 80 | 0.60 |
| 61 | 0.0 | 60 | 150 | 20 | 42 ≦ A ≦ 100 | 120 ≦ B ≦ 320 | 55 | 80 | — |
| 62 | 0.0 | 50 | 150 | 30 | 42.5 ≦ A ≦ 100 | 132 ≦ B ≦ 330 | 65 | 80 | — |
| 63 | 0.0 | 90 | 200 | 30 | 42.5 ≦ A ≦ 100 | 132 ≦ B ≦ 330 | 60 | 70 | 0.10 |
| 64 | 0.0 | 50 | 250 | 10 | 31 ≦ A ≦ 100 | 105 ≦ B ≦ 305 | 55 | 80 | — |
| 65 | 0.0 | 60 | 180 | 20 | 42 ≦ A ≦ 100 | 120 ≦ B ≦ 320 | 60 | 80 | — |
| 66 | 0.0 | 85 | 150 | 25 | 47.5 ≦ A ≦ 100 | 131 ≦ B ≦ 330 | 65 | 70 | 0.60 |
| 67 | 0.0 | 50 | 200 | 20 | 42 ≦ A ≦ 100 | 120 ≦ B ≦ 320 | 60 | 70 | — |
| 68 | 0.0 | 80 | 130 | 15 | 36.5 ≦ A ≦ 100 | 111 ≦ B ≦ 311 | 60 | 65 | 0.10 |
| 69 | 2.5 | 80 | 200 | 20 | 42 ≦ A ≦ 100 | 120 ≦ B ≦ 320 | 60 | 65 | 0.03 |
| 70 | 3.0 | 45 | 250 | 30 | 42.5 ≦ A ≦ 100 | 132 ≦ B ≦ 330 | 65 | 65 | 0.60 |
| 71 | 3.5 | 50 | 200 | 20 | 42 ≦ A ≦ 100 | 120 ≦ B ≦ 320 | 70 | 65 | — |
| 72 | 4.0 | 50 | 150 | 10 | 31 ≦ A ≦ 100 | 105 ≦ B ≦ 305 | 65 | 65 | — |
| 73 | 5.0 | 50 | 150 | 20 | 42 ≦ A ≦ 100 | 120 ≦ B ≦ 320 | 65 | 55 | 0.10 |
| 74 | 3.0 | 60 | 180 | 30 | 42.5 ≦ A ≦ 100 | 132 ≦ B ≦ 330 | 70 | 65 | — |
| 75 | 2.5 | 75 | 220 | 20 | 42 ≦ A ≦ 100 | 120 ≦ B ≦ 320 | 65 | 65 | — |
| 76 | 5.0 | 85 | 200 | 15 | 36.5 ≦ A ≦ 100 | 111 ≦ B ≦ 311 | 60 | 55 | 0.60 |
| 77 | 4.0 | 60 | 210 | 20 | 42 ≦ A ≦ 100 | 120 ≦ B ≦ 320 | 60 | 55 | — |
| 78 | 2.0 | 75 | 280 | 30 | 42.5 ≦ A ≦ 100 | 132 ≦ B ≦ 330 | 60 | 50 | 0.10 |

| Sample No. | Sulfurous acid (N) | Anodic electrolysis time (sec) | Cathodic electrolysis time (sec) | Quantity of electrolysis (C/dom2) | Maximum difference in glossiness | Appear-ance | Level | Remarks |
|---|---|---|---|---|---|---|---|---|
| 59 | — | — | — | — | 20 | Excellent | A | Within the invention |
| 60 | — | — | — | — | 15 | Excellent | A | Within the invention |
| 61 | 0.02 | — | — | — | 15 | Excellent | A | Within the invention |
| 62 | 0.30 | — | — | — | 20 | Excellent | A | Within the invention |
| 63 | 0.20 | — | — | — | 15 | Excellent | A | Within the invention |
| 64 | — | 5 | 40 | 80 | 15 | Excellent | A | Within the invention |
| 65 | — | 10 | 50 | 120 | 25 | Excellent | A | Within the invention |
| 66 | — | 3 | 50 | 60 | 15 | Excellent | A | Within the invention |
| 67 | 0.03 | 4 | 46 | 40 | 25 | Excellent | A | Within the invention |
| 68 | 0.20 | 5 | 45 | 20 | 20 | Excellent | A | Within the invention |
| 69 | — | — | — | — | 20 | Excellent | A | Within the invention |
| 70 | — | — | — | — | 15 | Excellent | A | Within the invention |
| 71 | 0.02 | — | — | — | 25 | Excellent | A | Within the invention |
| 72 | 0.30 | — | — | — | 25 | Excellent | A | Within the invention |
| 73 | 0.20 | — | — | — | 20 | Excellent | A | Within the invention |
| 74 | — | 5 | 40 | 80 | 15 | Excellent | A | Within the invention |
| 75 | — | 10 | 50 | 120 | 15 | Excellent | A | Within the invention |
| 76 | — | 3 | 50 | 60 | 20 | Excellent | A | Within the invention |
| 77 | 0.03 | 4 | 46 | 40 | 25 | Excellent | A | Within the invention |
| 78 | 0.20 | 5 | 45 | 20 | 25 | Excellent | A | Within the invention |

As shown in the above Examples, hot-rolled steel sheets having superior surface appearance, free of surface patterns and uneven glossiness, were prepared from austenitic stainless steel slabs containing about 0.03 percent by weight or more of Cu, about 0.03 percent by weight or more of V, and about 0.01 percent by weight or more of Mo under any of the following conditions:

(A) in the pickling step, the steel sheets were immersed into a nitric-hydrofluoric acid solution containing about 20 to 100 g/l of nitric acid and about 100 to 300 g/l of hydrofluoric acid;

(B) the nitric-hydrofluoric acid content was controlled within a specified range in response to the iron ion content in the solution;

(C) a preliminary pickling step using sulfuric acid, hydrochloric acid, or nitric-hydrofluoric acid was employed prior to the finishing pickling;

(D) 2 μm or more of the surface was mechanically ground after preliminary pickling and prior to finishing pickling;

(E) a counterflow at a relative flow rate of about 0.5 to 5.0 m/sec was introduced on the sheet surface during finishing pickling;

(F) sulfuric acid or sulfurous acid as a hydrogen ion source was added to the nitric-hydrofluoric acid solution; and (G) electrolysis was employed during finishing pickling such that the ratio of the cathodic electrolysis time to the anodic electrolysis time was about 3 or more.

What is claimed is:

1. A method of making an austenitic stainless steel sheet having excellent surface characteristics comprising hot rolling said austenitic steel, and annealing and pickling said austenitic stainless steel in a pickling solution, wherein said pickling solution comprises about 20 to 100 g/l of nitric acid and about 100 to 300 g/l of hydrofluoric acid.

2. A method of making an austenitic stainless steel sheet having excellent surface characteristics comprising hot rolling said austenitic steel, and annealing and pickling said austenitic stainless steel in a pickling solution, wherein said pickling solution comprises about 20 to 100 g/l of nitric acid and about 100 to 300 g/l of hydrofluoric acid, wherein when said pickling solution has a metal ion concentration C (g/l) in the range of about $0 \leqq C \leqq 25$, a nitric acid concentration A (g/l) and a free hydrofluoric acid concentration B (g/l) substantially satisfy the relationships (1) and (2) expressed below;

and when said metal ion concentration C is greater than about 25 g/l, the nitric acid concentration A and the free hydrofluoric acid concentration B substantially satisfy the relationships (3) and (4), expressed below:

$$20+1.10\times C \leqq A \leqq 100 \quad (1)$$

$$100+0.05\times C^2 \leqq B \leqq 300+0.05\times C^2 \quad (2)$$

$$20+0.75\times C \leqq A \leqq 100 \quad (3)$$

$$132 \leqq B \leqq 330 \quad (4).$$

3. A method according to claim 1, further comprising a preliminary pickling step for preliminarily pickling the austenitic stainless steel with sulfuric acid, hydrochloric acid or a mixed acid solution of nitric acid and hydrofluoric acid prior to said pickling step.

4. A method according to claim 3, further comprising a mechanical grinding step for mechanically grinding the surface of said stainless steel sheet between said preliminary pickling step and said pickling step.

5. A method according to claim 1, wherein said pickling solution further comprises an acid selected from the group consisting of sulfuric acid and sulfurous acid.

6. A method according to claim 1, wherein a counterflow is imparted along the surface of the steel sheet in performing said pickling step.

7. A method according to claim 6, wherein said counterflow has a flow rate relative to said steel sheet, said flow rate being in a range of about 0.5 to 5.0 m/sec.

8. A method according to claim 1, wherein said steel sheet contains about 0.03 percent by weight or more of Cu, about 0.03 percent by weight or more of V, and about 0.01 percent by weight or more of Mo.

9. A method according to claim 1, wherein said pickling step comprises alternating cathodic and anodic electrolytic treatment of said sheet at a ratio of cathode electrolysis time to anode electrolysis time of about 3 or more.

10. A method according to claim 4, wherein said mechanical grinding step applies to said steel at least one grinding means selected from the group consisting of a brush, high-pressure water, and a grinder.

11. A method according to claim 4, wherein said sheet has a thickness that is mechanically ground in said mechanical grinding step, said thickness being in a range of about 2.0 μm or more per single surface of said sheet.

12. A method according to claim 2, further comprising a preliminary pickling step for preliminarily pickling the austenitic stainless steel with sulfuric acid, hydrochloric acid or a mixed acid solution of nitric acid and hydrofluoric acid prior to said pickling step.

13. A method according to claim 12, further comprising a mechanical grinding step for mechanically grinding the surface of said stainless steel sheet between said preliminary pickling step and said pickling step.

14. A method according to claim 2, wherein said pickling solution further comprises an acid selected from the group consisting of sulfuric acid and sulfurous acid.

15. A method according to claim 2, wherein a counterflow is imparted along the surface of the steel sheet in performing said pickling step.

16. A method according to claim 15, wherein said counterflow has a flow rate relative to said steel sheet in a range of about 0.5 to 5.0 m/sec.

17. A method according to claim 2, wherein said steel sheet contains about 0.03 percent by weight or more of Cu, about 0.03 percent by weight or more of V, and about 0.01 percent by weight or more of Mo.

18. A method according to claim 2, wherein said pickling step comprises alternating cathodic and anodic electrolytic treatment of said sheet at a ratio of cathode electrolysis time to anode electrolysis time of about 3 or more.

19. A method according to claim 13, wherein said mechanical grinding step applies to said steel at least one grinding means selected from the group consisting of a brush, high-pressure water, and a grinder.

20. A method according to claim 13, wherein said sheet has a thickness that is mechanically ground in said mechanical grinding step, said thickness being in a range of about 2.0 μm or more per single surface of said sheet.

* * * * *

UNITED STATES PATENT AND TRADEMARK OFFICE

CERTIFICATE OF CORRECTION

PATENT NO. : 6,149,744
DATED : November 21, 2000
INVENTOR(S) : Fukuda et al.

It is certified that error appears in the above-identified patent and that said Letters Patent is hereby corrected as shown below:

Column 11,
Table 4, sample No. 34, at the subheading "Nitric acid (g/l)", please change "30" to -- 80 --.
Column 14,
Table 6, sample No. 39, at the subheading "Pickling time (sec)", please change "60" to -- 80 --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*